United States Patent [19]

Mackey

[11] Patent Number: 5,005,446

[45] Date of Patent: Apr. 9, 1991

[54] PRESSURIZED CORK-REMOVAL APPARATUS FOR WINE BOTTLES AND OTHER CONTAINERS

[76] Inventor: Edward R. Mackey, 28 Nottingham Rd., Dracut, Mass. 01826

[21] Appl. No.: 222,163

[22] Filed: Jul. 21, 1988

Related U.S. Application Data

[63] Continuation of Ser. No. 2,871, Jan. 13, 1987, abandoned.

[51] Int. Cl.[5] ..... B67B 7/08

[52] U.S. Cl. ..... 81/3.48; 141/19

[58] Field of Search ..... 81/3.2, 3.29, 3.36, 81/3.39, 3.48, 3.49; 222/5; 220/3, 304; 206/19; 141/329, 19

[56] References Cited

U.S. PATENT DOCUMENTS

| | | | |
|---|---|---|---|
| 986,855 | 3/1911 | Peck | 81/3.29 |
| 1,421,169 | 6/1922 | Chmura | 81/3.29 |
| 2,860,634 | 11/1958 | Doncan et al. | 222/5 |
| 4,317,390 | 3/1982 | Nakayama | 81/3.2 |
| 4,637,283 | 1/1987 | Bertram et al. | 81/3.2 |
| 4,694,850 | 9/1987 | Fumino | 222/5 |

*Primary Examiner*—James G. Smith

*Attorney, Agent, or Firm*—Pearson & Pearson

[57] ABSTRACT

Cork removal apparatus of the type in which gas under pressure is directed into a container thereby to eject a cork or like stopper. The apparatus directs gas from a gas cylinder into a gas reservoir sealed by a valve. The gas pressure provides the sealing force. When an actuator opens the seal, gas passes through a series of passages and a hollow needle that penetrates the stopper to exit within the container to eject the stopper.

A cover assembly on the needle completely encloses the needle. A disk at one end of the cover retracts as the needle is inserted into the stopper. After the stopper is ejected it remains on the needle within the cover. Tabs extending through the cover enable the disk to be returned to its original position thereby removing the stopper and enclosing the needle.

2 Claims, 5 Drawing Sheets

PRESSURIZED CORK-REMOVAL APPARATUS FOR WINE BOTTLES AND OTHER CONTAINERS

CROSS REFERENCE TO RELATED APPLICATION

This patent application is a continuation of U.S. patent application Ser. No. 002,871 filed by Edward R. Mackey on Jan. 13, 1987, now abandoned, for a PRESSURIZED CORK-REMOVAL APPARATUS FOR WINE BOTTLES AND OTHER CONTAINERS.

BACKGROUND OF THE INVENTION

I. Field of the Invention

The present invention relates to container stopper removing devices, being more particularly, though not exclusively, concerned with the gas-pressurized release of wine bottle corks and the like, the term "cork" being used herein in a generic sense to embrace stopper or other capping devices for liquid-carrying and other containers and the like.

Prior apparatus for effecting gas-pressure release of, for example, wine bottle corks and the like range from disposable one-time-use pressurized gas bombs, cartridges or cylinders that apply gas under pressure through a cork-penetrating needle into the air space in the neck of the bottle above the wine level to force the cork out of the neck, to multi-use apparatus employing valves for effectively opening and closing the pierced gas cylinder outlet region or for repetitively piercing and sealing the gas cylinder cap, as described, for example, in U.S. Pat. Nos. 4,317,390 and 4,464,956.

The use of repetitive piercing and sealing of the gas cylinder or its immediate outlet region, however, is attendant with gas-leakage problems and a significant variation in the performance efficacy during successive uses of the device, particularly as the volume of remaining gas in the cylinder or cartridge diminishes. Relatively complicated, costly and adjustment-necessary valve structures have, moreover, been required, as well.

SUMMARY

An object of the present invention, on the other hand, is to provide a new and improved cork-removal apparatus of this character that obviates such disadvantages and difficulties and that, to the contrary, enables a fixed and controlled single penetration of a gas cylinder, that is adapted for multi and repetitive use, with a simple refillable and inexpensive combined valve system and gas reservoir chamber or compartment that is remarkably gas tight and provides markedly improved uniformity of operation for successive or repetitive uses.

A further object is to provide an improved gas-pressurized cork remover of more general utility, as well.

Other and further objects will occur and be explained hereinafter and are more particularly delineated in the appended claims.

In accordance with one aspect of this invention, a cork removing apparatus transfers gas from a gas cylinder with a thin seal at the opening thereof through a hollow needle means that pierces a cork to pressurize a container and eject the cork. Gas passages in the housing conduct the gas from the gas cylinder to the hollow needle means. A pressure actuated valve assembly means interposed in the gas passage means pierces the seal on the gas cylinder to admit the gas to an input port means to a gas reservoir. A valve means, including a pressure actuated piston means mounted on a valve stem means, carries a sealing means. When the apparatus is in its normal state, gas pressure from the cylinder and in the reservoir forces the piston means and its sealing means into engagement with the sealing seat. An actuator on the apparatus, when used, overcomes the force exerted by the gas on the piston means and displaces the valve stem means to separate the sealing means and the sealing seat thereby to permit the gas to flow through the hollow needle means thereby to eject the cork. When the cork is removed, the actuator is released, and the gas pressure from the cylinder and reservoir force the piston means back to its sealing position. Preferred details of construction and best mode embodiment are later presented.

BRIEF DESCRIPTION OF DRAWINGS

The invention will now be described with reference to the accompanying drawings, FIG. 1 of which is a longitudinal section of one embodiment of the invention, in a normal inoperative state.

Figure 1:
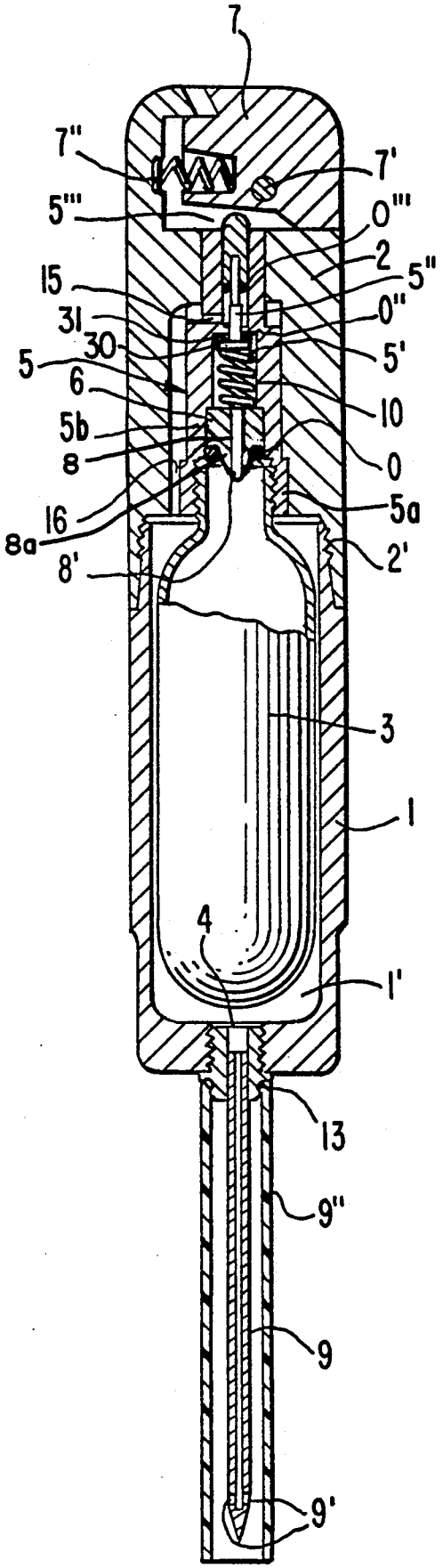
Figure 2:
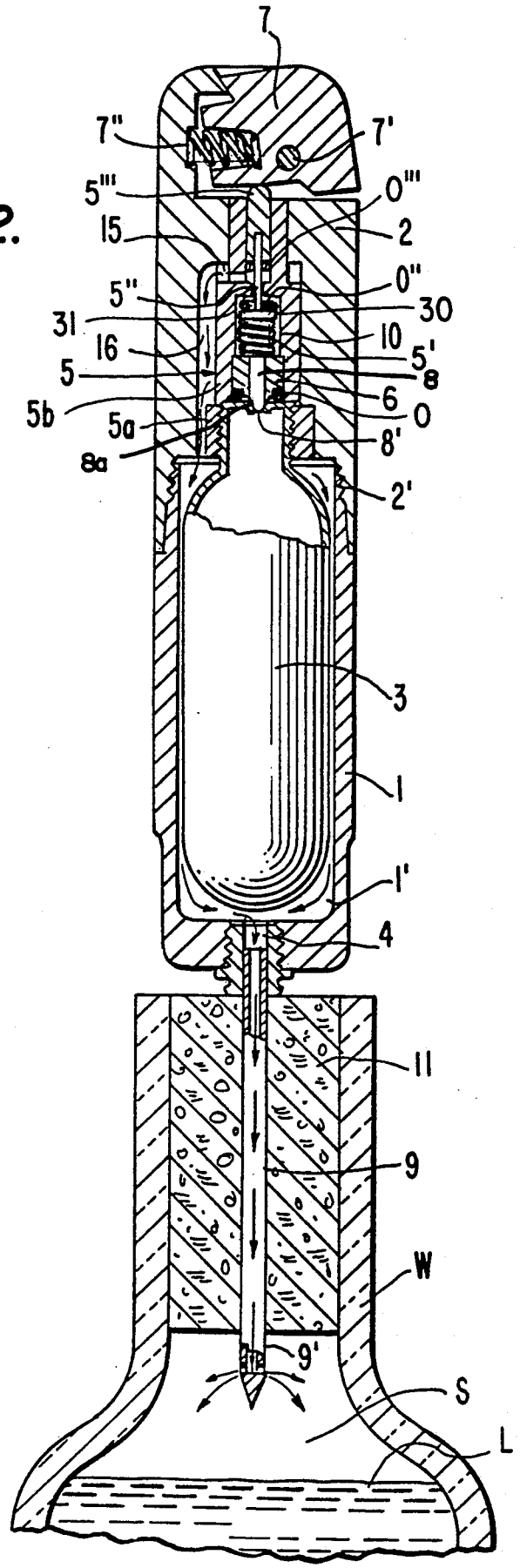
FIG. 2 is a similar view of the apparatus in use, shown applied for the removal of a wine bottle cork.
Figure 5:
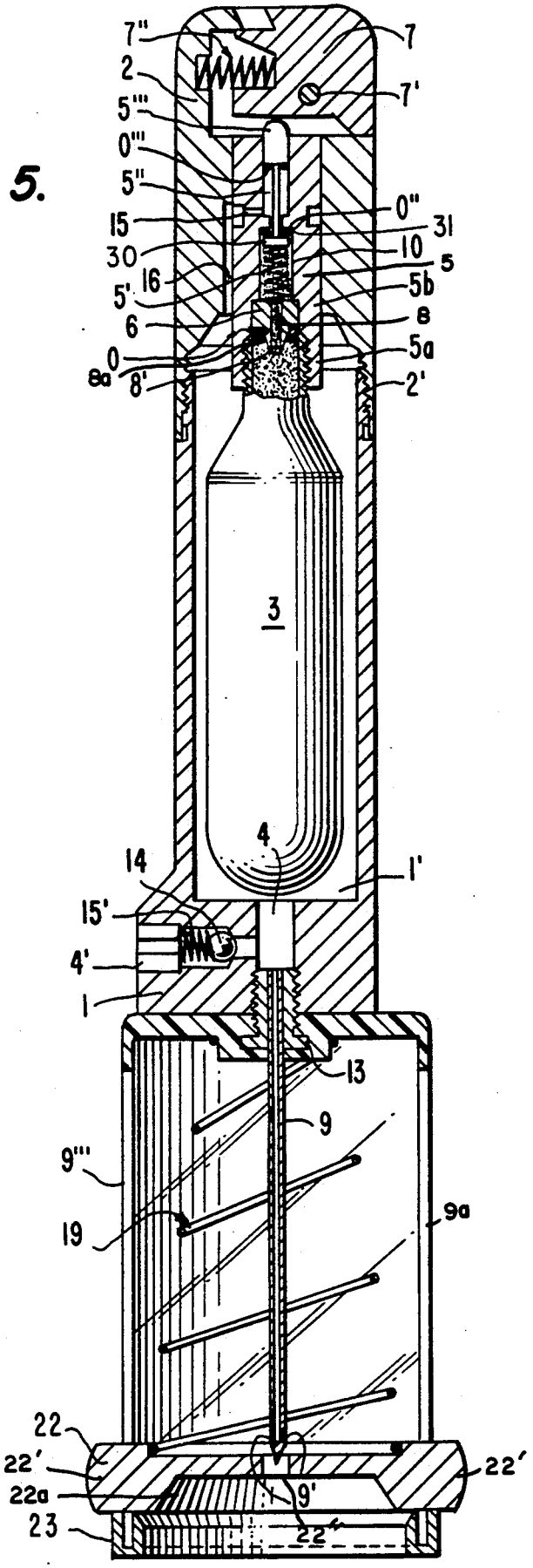
FIGS. 5 and 6 are views similar to FIGS. 1 and 2, respectively, of a modification embodying a permanently attached needle cover and apparatus for stripping a cork from the needle. Description of Illustrative Embodiments Referring to FIG. 1, the stopper cork remover apparatus is shown comprising a cylindrical housing, as of plastic or metal or the like, having a lower internally recessed housing portion 1 containing within its recess 1' a pressurized gas cylinder 3 (such as $CO_2$, or the like), and an upper housing portion 2 detachably threaded at 2' to the lower portion 1 and internally containing a valving system including a valve body 5, which valving system is actuated by a pivotal actuating button 7. The bottom wall of the lower housing portion recess 1' is apertured at 4 to permit pressured gas that may be released from the cylinder 3 under action of the valving system, as later explained, to exit from near terminal openings 9' in a depending hollow needle 9 adapted to penetrate the stopper or cork 11 in, for example, a wine bottle or other container W, FIG. 2, into the space S above the contents level L, to force the cork 11 upward and out of the bottle.
Figure 6:
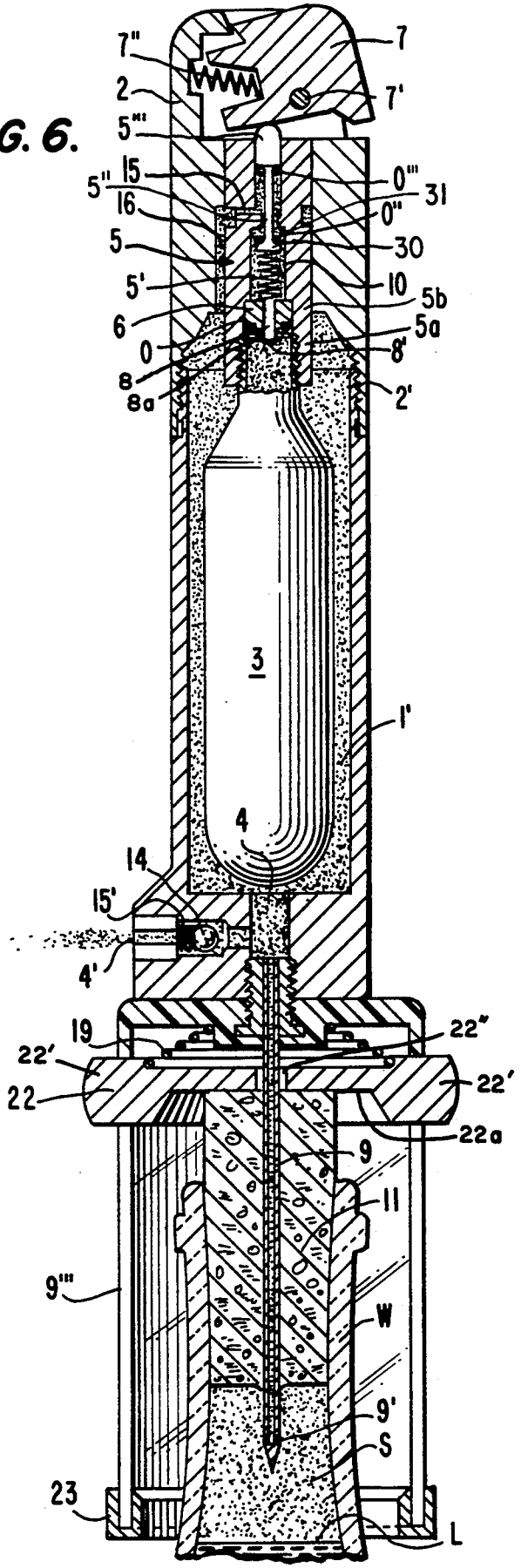

Turning to the details of the valving system, the valve body 5 contains a lower housing **5*a* (which may be an insert as shown in FIGS. 1 and 2 or an integral valve body part as shown in FIGS. 5 and 6) and a cylinder stop 6 with an axially extending passage 8 terminating at a gas cylinder-piercing a section that fixedly punctures the gas cylinder top at 8', when the lower housing 5*a* is threaded upon the upper neck of the gas cylinder 3, as shown. A valve body 5*b* defines a chamber or compartment 10, and a valve stem spring 5' bears upon the top of the cylinder stop 6 and extends upwardly within the chamber or compartment 10, that serves both to contain a spring 5' and act as a gas reservoir external to the cylinder 3 with the piercing section 8*a* acting as an input port to the reservoir 10**.

A pressure-actuated valve comprises a valve stem 5'' that terminates in an extension or piston 30. This valve reciprocates along an axis in the valve body 5. An O-ring 0'' on the piston 30 provides a seal between the reservoir 10 and the remaining passages of the removal apparatus by sealing against a seat 31 defined by an internal shoulder in the valve body 5. The valve stem 5'' protrudes to a point just below the top-actuating button 7 and defines a valve actuator cam follower 5'''. An O-ring 0''' serves as a seal between the passages downstream from the piston 30 and the atmosphere to prevent leakage around the valve stem 5'' and the actuator cam follower 5'''.

A lower O-ring 0 along the underside of the cylinder stop 6 housing serves as a peripheral gas cylinder seal after the piercing section 8 *a* penetrates the seal of the gas cylinder. Once the gas cylinder cap is pierced, the gas enters the passage 8 from the piercing tube 8*a* and travels into the reservoir chamber 10 around the valve stem spring 5' contained therein, being sealed therein in the position of FIG. 1 by the piston 30 and the valve stem seal 0''. When the top actuator 7 opens the pressure actuated valve, a flow communication is established with recess 1' through upper side holes 15 and communicating lateral slot passageways 16 (FIG. 2); but in the quiescent state (FIG. 1), the gas is sealed in the chamber 10 and cannot communicate with the passageway 16.

Figure 3:
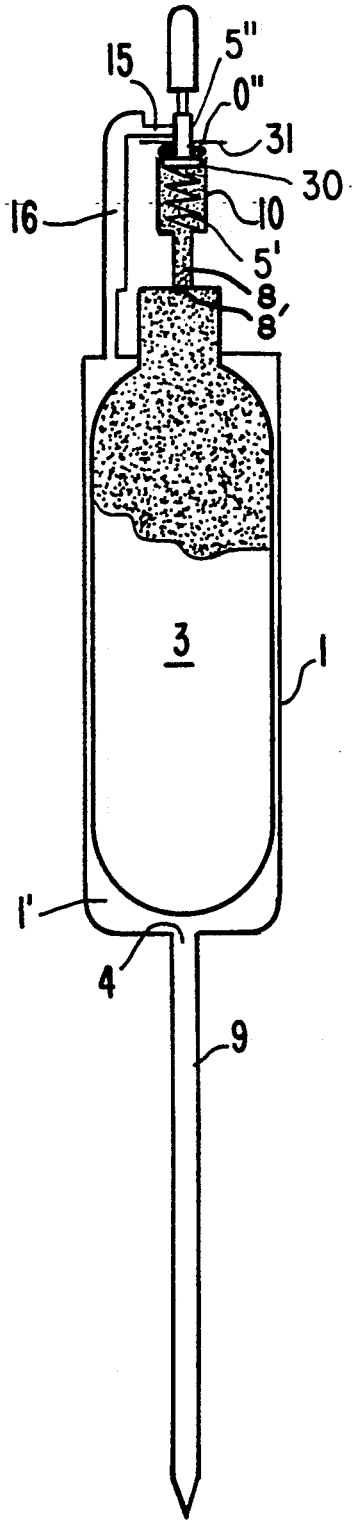
FIGS. 3 and 4 are fragmentary schematic views similar to FIGS. 1 and 2, respectively, diagrammatically illustrating pressurized gas storage and use.

In operation, once the protective needle cover 9'' is threaded off the insert needle holder and cover lock 13, FIG. 1, and pierces the bottle cork 11 or the like, FIG. 2, gas from the cylinder 3 passes, as before explained, from the reservoir chamber 10 containing the valve stem spring 5', being contained or trapped in this reservoir volume external to the gas cylinder as pressure is exerted on the piston 30 of the valve stem 5'' and in turn on the cylinder seal O-ring 0'' located under the valve piston 30. Thus, in accordance with the invention, the initial release and sealing technique above-described employs the gas pressure acting on the piston 30 to effect the seal—i.e., the higher the pressure from the cylinder 3, the better the seal. This stored condition is shown in FIG. 3, with the shading representing the pressurized gas. The spring 5' merely biases the valve 5 shut when no gas pressure is applied, as when the gas cylinder 3 is empty or removed.

Figure 4:
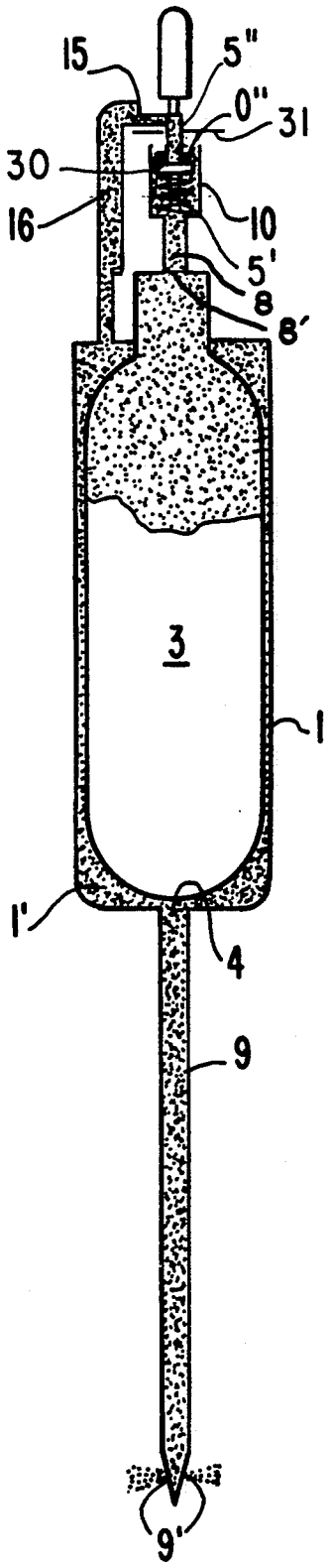

Upon depression of the actuation button 7 about its pivot or dowel 7' and in opposition to the lateral return spring 7'', the valve stem actuator cam follower 5'' to one side of, but just under, said pivot 7' and the valve stem 5' are depressed, FIG. 2, overcoming the force produced by the gas in the reservoir chamber 10 and its back-up from the cylinder 3 acting on the piston 30. This opens the seal at the O-ring 0'' and the gas travels around the valve stem 5'' through the before-mentioned side holes 15 in the valve body down the lateral slot passageways 16 in the upper housing portion 2 external to the valve body and into the recess 1' of the lower housing portion surrounding the gas cylinder 3 and down through the needle 9, exiting at its side holes 9', as before explained. This condition is illustrated by the shaded gas paths of FIG. 4.

When the actuator 7 is released, the spring 7'' biases the actuator 7 to its normal position. The gas pressure forces the piston 30 to its sealing position. This forces the O-ring 0'' against the valve seat 31 thereby sealing the reservoir 10. As apparent, the pressure in the side holes 15, passageways 16, recess 1'' and the needle 9 returns to atmospheric pressure.

As previously stated, and unlike some of said prior patent proposals, the invention thus always keeps the piercing pin or tube 8 in a fixed position and at fixed depth in the pierced gas cylinder or cartridge 3 and does not re-insert into it or try to valve the cylinder outlet in each use, with attendant leakage and other problems. The reservoir of gas is sealed by pressure of the gas in the reservoir 10 and the cylinder 3 acting on the piston 30 in the valve spring compartment or chamber 10 above the gas cylinder 3 until the actuation button is depressed, whence the gas stored in the reservoir compartment 10 and additional back-up gas under pressure from the cylinder 3 becomes released via side holes 15 and passageways 16 and recess 1' through the needle 9 until the actuator button is released and the system is restored to the inoperative position of FIG. 1, and with a new supply of gas stored and sealed in the valve stem gas reservoir compartment 10 again. This operation provides substantial uniformity of operation during repetitive uses.

The gas cylinders or cartridges 3 are readily attached by unlocking or unscrewing the upper and lower housing portions 2 and 1 at 2', threading the neck of a cylinder 3 into the lower housing 5*a* of the upper housing portion 2 tightly by hand, causing the piercing section 8*a* to penetrate the gas cylinder the desired amount or depth, and re-threading or locking the upper and lower housing portion at 2'.

As shown in FIG. 5, a lateral relief valve 4' comprising a ball 14 and spring 15' urged normally to close off communication with the opening 4 is also provided to prevent excessive pressure on the bottle-to-be-opened. If the pressure inside the housing 1, and hence inside the bottle, exceeds a predetermined safe limit, the valve opens and exhausts the gas to the atmosphere. This reduces the pressure to a safe level. Such pressure relief valves are well known in the art.

In the embodiment of FIGS. 5 and 6, added safety is provided by means of a permanent larger diameter needle protective cover 9''' that receives the bottle top, FIG. 6, (preferably transparent as of "Lexan" plastic or the like to permit operational viewing), instead of the removable sheath cover 9'' of FIG. 1. In operation, FIG. 6 (with gas flow represented by the shading), the bottle top is received within the cover 9''' through its base 23, forcing the stripper plate 22 against the spring 19 slidingly upwardly within the cover as the needle tube 9 penetrates the cork 11. As before, gas is shown forced around the valve stem 5'' and laterally outwardly and then downwardly in the space 16 about the gas cylinder 3, out the opening 4 and through the needle tube 9, exiting through the needle side apertures 9' to pressurize the volume between the cork 11 and the wine level L and force the cork out.

As will be apparent from FIGS. 5 and 6, the cover 9''' is cylindrical and closed at one end that captures a needle holder or body portion 13. The portion 13 supports the needle 9 and connects both the needle 9 and the cover 9''' to the lower housing 1. The stripper plate 22 is generally disk-shaped with two tabs, or ears, 22' extending through axially extending slots 9*a* formed in the circumference of the cover 9''' . The base 23 closes the slots 9*a* and provides a guiding collar for the apparatus when it is placed on a bottle or like container. The stripper plate 22 thereby is captured in the cover 9''' by the base 23. The spring 19 biases the stripper plate 22 to the position shown in FIG. 5 so the disk lies below the piercing end 9' of the needle 9.

The stripper plate 22'' also has a small central aperture 22' that passes over the needle 9 as the apparatus is placed over a cork and forced downward as shown in FIGS. 5 and 6 so the needle 9 penetrates the cork until the piercing end 9′ lies below the cork. When the actuator 7 is moved, gas is directed into the bottle and pushes the cork out of the bottle. The cork 11 contacts a lower surface 22*a* on the stripper plate 22 adjacent the aperture 22″ thereby moving the stripper plate 22 and compressing the spring 19 forcing the apparatus with it. The cork then is captured on the hollow needle 9. By grabbing the extensions 22′ on the stripper plate 22 and pushing them toward the open end of the cover 9′, downwardly in FIGS. 5 and 6, the stripper plate 22 pushes the cork off the needle and returns to the position in FIG. 5 thereby fully enclosing the needle 9.

Further modifications will also occur to those skilled in this art, and such are considered to fall within the spirit and scope of the invention as defined in the appended claims. What is claimed as new and desired to be secured by Letters Patent of the United States is:

What is claimed is:

1. In apparatus for removing a stopper from a container of the type including a housing, an exit port in the housing, a gas cylinder, and valve means for directing gas from the cylinder to the exit port, the improvement of a needle assembly comprising;

A. hollow needle means connected at a first end to the exit port for penetrating a stopper and conducting gas under pressure into the container through a second end of said needle means thereby to force the stopper out of the container, B. open-ended cylindrical cover means rigidly attached to said first end of said needle means and extending coaxially with said needle means, said cover means including longitudinal slots formed therein, C. stripper plate means having a central section with a planar surface for abutting the stopper, a central aperture for receiving said needle means through said central section and transversely extending ears extending through said longitudinal slots thereby to enable an operator to push the stopper off said needle means after a stopper is removed from a container, said needle thereafter being completely encased by said cover means and said stripper plate means, D. capture means mounted to said cover means at the open end thereof to capture said stripper plate means, the longitudinal dimension of said cover means and said capture means exceeding the length of said needle means, and E. spring means mounted in said cover means solely for biasing said stripper plate means toward said capture means, said capture means being positioned so said stripper plate means and said cover means normally encase all of said needle means.

2. A needle assembly for a stopper removing apparatus as recited in claim 1 wherein said cover means is closed at the first end of said needle means and said needle means includes a sleeve at the first end thereof, said sleeve being fixed to the closed end of said cover means and to the housing at the exit port thereof.

* * * * *